US009668596B2

(12) United States Patent
Crescenzo

(10) Patent No.: US 9,668,596 B2
(45) Date of Patent: Jun. 6, 2017

(54) HANGING SYSTEM FOR INSTALLATION ON AN INTERIOR SURFACE OF A FRAME

(71) Applicant: Philip J. Crescenzo, Buena, NJ (US)

(72) Inventor: Philip J. Crescenzo, Buena, NJ (US)

( * ) Notice: Subject to any disclaimer, the term of this patent is extended or adjusted under 35 U.S.C. 154(b) by 239 days.

(21) Appl. No.: 13/846,416

(22) Filed: Mar. 18, 2013

(65) Prior Publication Data

US 2014/0263924 A1 Sep. 18, 2014

(51) Int. Cl.

| | |
|---|---|
| ***A47G 1/22*** | (2006.01) |
| *A47G 1/24* | (2006.01) |
| *A47G 1/16* | (2006.01) |

(52) U.S. Cl.

CPC ..... *A47G 1/22* (2013.01); *A47G 1/16* (2013.01); *A47G 1/24* (2013.01); *Y10T 29/49826* (2015.01)

(58) Field of Classification Search

CPC ..... A47G 1/21; A47G 1/215; A47G 1/24
USPC ..... 248/495, 497, 489, 475.1, 217.3, 218.1, 248/216.1, 317, 546, 544, 216.4, 490; 40/757, 779

See application file for complete search history.

(56) References Cited

U.S. PATENT DOCUMENTS

| | | | | | |
|---|---|---|---|---|---|
| 350,678 | A * | 10/1886 | Hussey | E05B 17/0025 | 292/198 |
| 763,448 | A * | 6/1904 | Winter | A47G 1/20 | 248/493 |
| 1,023,502 | A | 4/1912 | Callanan | | |
| 1,297,584 | A | 3/1919 | Mock | | |
| 1,676,131 | A * | 7/1928 | Campos | A47G 1/24 | 248/479 |
| 1,883,834 | A | 1/1932 | Turner | | |
| 3,226,065 | A * | 12/1965 | Smith | A47G 1/22 | 248/493 |
| 3,300,173 | A | 1/1967 | Kennedy, Jr. | | |
| 3,551,939 | A | 1/1971 | Rager | | |

(Continued)

FOREIGN PATENT DOCUMENTS

| | | |
|---|---|---|
| GB | 2 333 820 | 8/1999 |
| RU | 2082307 | 6/1997 |

OTHER PUBLICATIONS

PCT International Search Report and Written Opinion of counterpart PCT/US2013/070646, Feb. 20, 2014 (7 pages).

(Continued)

*Primary Examiner* — Muhammad Ijaz
(74) *Attorney, Agent, or Firm* — Cohen & Hildebrand, PLLC

(57) ABSTRACT

A frame hanger including a substantially planar fixed section, wherein a portion of the perimeter of the fixed section defines a substantially linear mounting guide edge. A single arm is rotatably mounted to the fixed section between a fully extended state and a fully retracted state. While in the fully retracted state, no portion of the arm extends beyond the mounting guide edge of the substantially planar fixed section. In a fully extended state, a pointed end of the arm extends beyond the mounting guide edge of the planar fixed section. A barrier prohibits rotation of the arm, when in the fully extended state, greater than a predetermined acute angle relative to the mounting guide edge. The arm and fixed section lie either in a common single plane or two planes substantially parallel to one another. Alternatively, the arm is integral with and non-rotatable relative to the fixed section.

8 Claims, 8 Drawing Sheets

(56) References Cited

U.S. PATENT DOCUMENTS

| | | | | |
|---|---|---|---|---|
| 3,858,269 | A | 1/1975 | Sutton et al. | |
| 4,083,525 | A | 4/1978 | Rath | |
| 4,226,394 | A | 10/1980 | Einhorn | |
| 4,566,665 | A | 1/1986 | Rynearson | |
| 4,637,583 | A | 1/1987 | Balatz | |
| 4,697,669 | A * | 10/1987 | Bergsten | E06C 9/04 182/189 |
| 4,858,351 | A | 8/1989 | Sewell et al. | |
| 4,970,754 | A | 11/1990 | Anderson et al. | |
| 5,015,118 | A | 5/1991 | Sewell et al. | |
| 5,269,485 | A * | 12/1993 | Dwinell | A47G 1/20 248/205.3 |
| 5,328,139 | A | 7/1994 | Barnes | |
| 5,332,108 | A | 7/1994 | Blass | |
| 5,409,489 | A | 4/1995 | Sioufi | |
| 5,454,542 | A | 10/1995 | Hart | |
| 5,584,462 | A | 12/1996 | Reese | |
| 5,588,629 | A | 12/1996 | Barnes | |
| 5,605,313 | A | 2/1997 | Erickson et al. | |
| 5,794,901 | A | 8/1998 | Sigel | |
| D402,183 | S | 12/1998 | Bellehumeur | |
| 5,878,987 | A | 3/1999 | Hayde | |
| 5,921,518 | A * | 7/1999 | Bernardi | A47G 1/1633 248/304 |
| 6,042,078 | A | 3/2000 | Donovan | |
| 6,095,478 | A * | 8/2000 | Barnes | A47G 1/22 248/216.1 |
| 6,126,126 | A | 10/2000 | McKiernan, Jr. | |
| 6,186,466 | B1 | 2/2001 | Baird et al. | |
| 6,206,334 | B1 | 3/2001 | Weck et al. | |
| 6,241,210 | B1 | 6/2001 | Brindisi | |
| 6,439,520 | B1 * | 8/2002 | Johnson | A47G 1/22 248/218.1 |
| 6,471,169 | B1 | 10/2002 | Maloney | |
| 6,484,996 | B2 | 11/2002 | Astell | |
| 6,708,367 | B2 | 3/2004 | Billson | |
| 6,840,489 | B2 | 1/2005 | Barnes | |
| 6,957,717 | B1 | 10/2005 | White et al. | |
| 6,962,016 | B1 | 11/2005 | Meyer | |
| 7,249,624 | B2 | 7/2007 | Zeh et al. | |
| D572,122 | S | 7/2008 | Cave | |
| 7,431,258 | B2 | 10/2008 | Lamotta | |
| 7,497,028 | B2 * | 3/2009 | Nevers | A47G 1/1606 33/613 |
| 7,891,616 | B2 | 2/2011 | Pinchuk et al. | |
| 2006/0282981 | A1 | 12/2006 | Speck et al. | |
| 2007/0194191 | A1 | 8/2007 | Persson | |
| 2007/0286704 | A1 * | 12/2007 | Signor | A47G 1/168 411/458 |
| 2009/0294610 | A1 | 12/2009 | Paharik et al. | |
| 2010/0096532 | A1 | 4/2010 | Greve | |
| 2010/0102011 | A1 | 4/2010 | Blum | |
| 2012/0036754 | A1 * | 2/2012 | Van Bortel | A47G 1/06 40/711 |
| 2013/0026319 | A1 * | 1/2013 | Crescenzo | A47G 1/17 248/216.4 |
| 2014/0263924 | A1 * | 9/2014 | Crescenzo | A47G 1/22 248/495 |

OTHER PUBLICATIONS

Copending U.S. Appl. No. 13/193,067, filed Jul. 28, 2011.
Copending U.S. Appl. No. 13/681,615, filed Nov. 20, 2012.
www.ooks.com; Framestraight Pins; Internet (date unknown).

* cited by examiner

HANGING SYSTEM FOR INSTALLATION ON AN INTERIOR SURFACE OF A FRAME

BACKGROUND OF THE INVENTION

Field of the Invention

The present invention is directed to a hanging system for installation on an interior surface of a frame used to display a diploma, a photograph, artwork, a mirror, shadowbox or any other object to be framed.

Description of Related Art

Conventional frames are used to display a diploma, canvas, photograph, artwork, mirror, shadowbox or any other object to be framed. Frames made of wood are particularly prevalent; however, other materials may be used. A closed frame, typically in the form of a rectangle or square, is formed by assembling one or more frame sections end-to-end.

Framed objects are generally hung from the wall using a wire. The use of a wire creates instability in the object being hung when the wire slides along the hook secured to the wall and/or the object bangs against the wall on which it is hung. Thus, a frame that is level when initially hung, thereafter may slide along the wire from the hook on which it is hung so that it no longer is level. Moreover, when hanging a framed object using a hook and wire it is difficult to maintain the back surface of the frame completely flush against the wall. Instead, only the bottom edge of the frame physically contacts the wall, while the top edge of the frame held by the wire pulls or sags away from the wall. It is thus desirable to develop a hanging system and apparatus that eliminates the use or need for any hanging wires and separate complementary mating frame hanger components mounted only to the wall while insuring that the frame is stable and completely flush against the wall or other surface on which the frame is hung.

A large volume of today's retail market consists of consumer purchases over the Internet without ever entering a brick-and-mortar retail store. In some limited occurrences, Internet purchases may be physically picked up at a local brick-and-mortar retail store. However, in the preponderance of cases today, and a predicted exponential number in the future, an Internet purchased item is shipped directly to the intended recipient at his/her desired address, rather than being picked up at a physical retail store. When designing a frame hanging system it is therefore desirable to take into consideration several factors including, but not limited to, minimizing the overall cost of manufacture, minimizing the overall size and weight that would otherwise contribute to shipping cost, and minimizing any installation/assembly associated with hanging the framed object once it has been received by the consumer using only conventional tools found in most households.

It would be desirable to develop an inventive hanging system for a framed object that addresses each of these constraints.

SUMMARY OF THE INVENTION

The present invention is directed to an inventive hanging system for a framed object to be hung on a wall or other surface that is able to be transported/stored in a retracted state; minimizes the overall cost of manufacture; minimizes the overall size and weight that would otherwise contribute to shipping cost; and minimizes any installation/assembly associated with hanging the framed object once it has been received by the consumer using only conventional tools found in most households.

Another aspect of the present invention is to develop a hanging system for a framed object that eliminates the need for a wire and/or separate complementary mating frame hanger component mounted only to the wall.

Yet another aspect of the present invention is to design a hanging system for a framed object to insure that the framed object is stable and the back of the frame is completely flush against the wall or other surface on which it is to be hung.

Still another aspect of the present invention is directed to a frame hanger including a substantially planar fixed section, wherein a portion of the perimeter of the fixed section defines a substantially linear mounting guide edge. A single arm is rotatably mounted to the fixed section between a fully extended state and a fully retracted state. While in the fully retracted state, no portion of the arm extends beyond the mounting guide edge of the substantially planar fixed section. In a fully extended state, a pointed end of the arm extends beyond the mounting guide edge of the planar fixed section. A barrier prohibits rotation of the arm, when in the fully extended state, greater than a predetermined acute angle relative to the mounting guide edge. The arm and fixed section lie either in a common single plane or two planes substantially parallel to one another. Alternatively, the arm is integral with and non-rotatable relative to the fixed section.

While another aspect of the present invention relates to a method for hanging on a wall an object displayed on a frame using two of the frame hangers described in the previous paragraph. The frame has two vertically oriented substantially parallel frame sections, two horizontally oriented substantially parallel frame sections, an interior surface, an opposite exterior surface, a mounting surface mountable flush against the wall, and an opposite display surface on which the object is displayed. Initially, the substantially planar fixed section of each of the frame hangers is positioned so that the substantially linear mounting guide edge is aligned with the mounting surface of the frame while the arm is rotated to the fully extended state. Each of the properly positioned frame hangers is then secured only to the interior surface of each of the two vertically oriented substantially parallel frame sections while the arm is rotated to the fully extended state. The user then rests a horizontal bottom edge of the mounting surface of the frame against the wall at a desired position in which the frame is to be hung. Using as a leverage point the horizontal bottom edge of the mounting surface of the frame resting against the wall, the user presses on the frame proximate a horizontal top edge of the display surface puncturing the wall with the two pointed ends of the two arms of the respective frame hangers. Lastly, the user pushes the arms further into the wall until the mounting surface of the frame is completely flush against the wall.

Yet another aspect of the present invention is directed to a frame hanger including a substantially planar fixed section having a top surface, a bottom surface and a perimeter; a portion of the perimeter of the fixed section defining a substantially linear mounting guide edge. The frame hanger also includes a single non-rotatable arm integral with and sharing a common single plane as that of the substantially planar fixed section; the arm terminating in a pointed end; the pointed end of the arm projects from the substantially linear mounting guide edge of the substantially planar fixed section at an angle between approximately 50 degrees and approximately 80 degrees. At least one hole is defined in the fixed section.

While another aspect of the present invention relates to a method for hanging on a wall an object displayed on a frame using two frame hangers. Each of the two frame hangers includes: a substantially planar fixed section having a top surface, a bottom surface and a perimeter; a portion of the perimeter of the fixed section defining a substantially linear mounting guide edge. In addition, each of the two frame hangers also includes a single arm terminating in a pointed end that projects from the substantially linear mounting guide edge of the substantially planar fixed section at an angle between approximately 50 degrees and approximately 80 degrees. As for the frame, it has two vertically oriented substantially parallel frame sections, an interior surface, an opposite exterior surface, a mounting surface to be flush against the wall when the frame is hung, and an opposite display surface on which the object is displayed. Initially, the substantially planar fixed section of each of the frame hangers is positioned so that the substantially linear mounting guide edge is aligned with the mounting surface of the frame with the pointed end of the arm oriented away from the frame. Then, each of the properly positioned frame hangers is secured to the interior surface of each of the two vertically oriented substantially parallel frame sections. The user rests a horizontal bottom edge of the mounting surface of the frame against the wall at a desired position in which the frame is to be hung. Using as a leverage point the horizontal bottom edge of the mounting surface of the frame resting against the wall, the user presses on the frame proximate a horizontal top edge of the display surface of the frame puncturing the wall with the two pointed ends of the two arms of the respective frame hangers. Lastly, the user pushes the arms further into the wall until the mounting surface of the frame is completely flush against the wall.

BRIEF DESCRIPTION OF THE DRAWING

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE INVENTION

Figure 5:
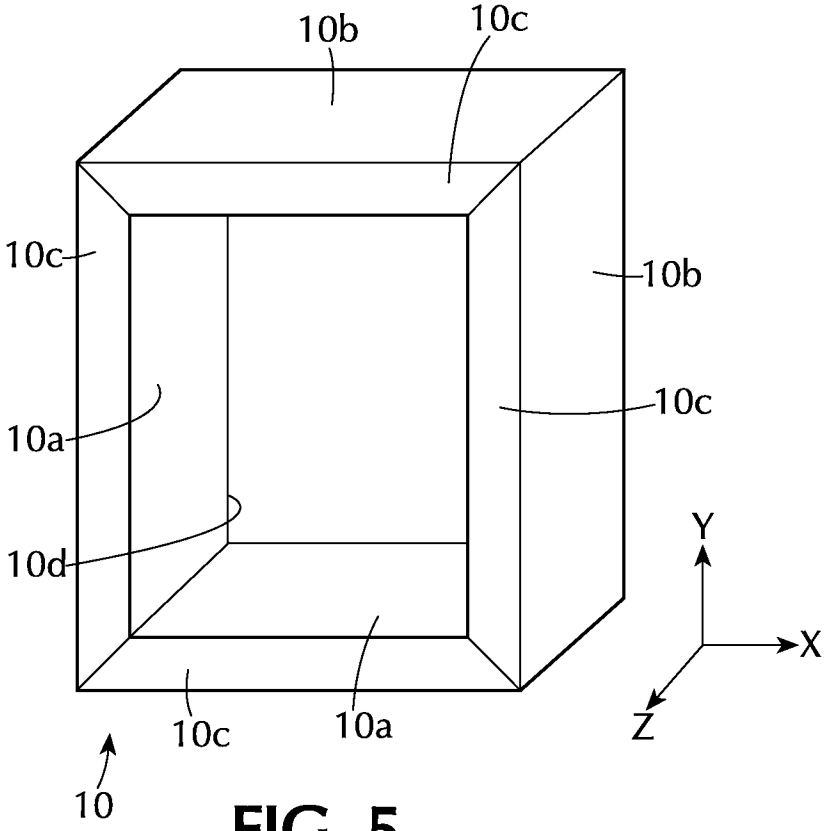
FIG. 5 is a conventional frame to which an object to be displayed may be mounted and the framed object hung on a wall or other planar surface.

The present invention is directed to a hanging system mounted to a frame used to display a diploma, a photograph, canvas, artwork, a mirror, a shadow box or any other object to be framed. Typically, the frame represents a closed geometric shape (e.g., rectangle, square, circle, or other geometric shape) comprising multiple frame sections assembled together end-to-end forming a three-dimensional structure open at least on one face (mounting surface) thereof that when hung is completely flush against the wall. Alternatively, an integrated single piece frame may be used thereby eliminating having to assemble one or more frame sections together end-to-end. By way of illustrative example, frame 10, depicted in FIG. 5, comprises four frame sections assembled end-to-end to form a four-sided rectangular shape block open at opposing top and bottom faces in the z-direction. An object to be displayed is mounted to the top face 10*a* while the open bottom face 10*c* is mounted flush against the wall when the framed object is hung. Frame 10 includes one pair of parallel frame sections positioned vertically and the other pair of parallel frame sections positioned horizontally, as shown in FIG. 5. The open rectangular shape frame has an interior surface 10*a* defining a cavity therein, an opposite exterior surface 10*b*, a mounting surface 10*c* forming an open face that rests in physical contact flush against the wall when the framed object is hung, and an opposite display surface 10*d* on which the object being framed is displayed. The interior surfaces 10*a* of the frame 10 are substantially perpendicular to the object being displayed as well as the wall on which the frame object is hung. For example, a canvas artwork may be stretched across the display surface 10*d* and extend around at least a portion of the exterior surface 10*b*. Similarly a mirror may be secured only to the display surface 10*d*. Due to its specific design the present inventive hanging system is secured only to the interior surface 10*a* of the vertically oriented pair of parallel frame sections, not to the horizontally oriented pair of parallel frame sections, when the framed object is held level with its mounting surface 10*c* facing the wall. Furthermore, the present inventive hanging system is secured only to the frame, not to the back of the displayed object.

Figure 1B:
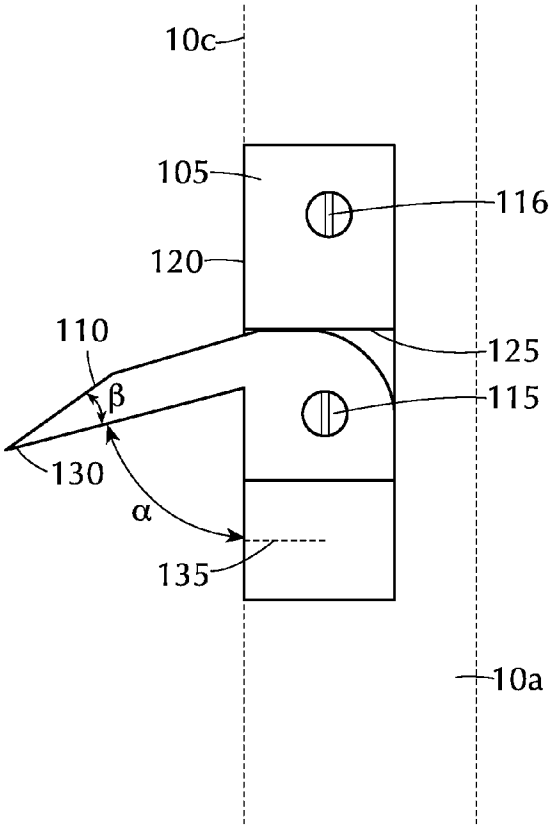
FIG. 1B is a perspective view of the frame hanger of FIG. 1A wherein the arm is in a fully extended state and locked into position by the crimp.
Figure 1C:
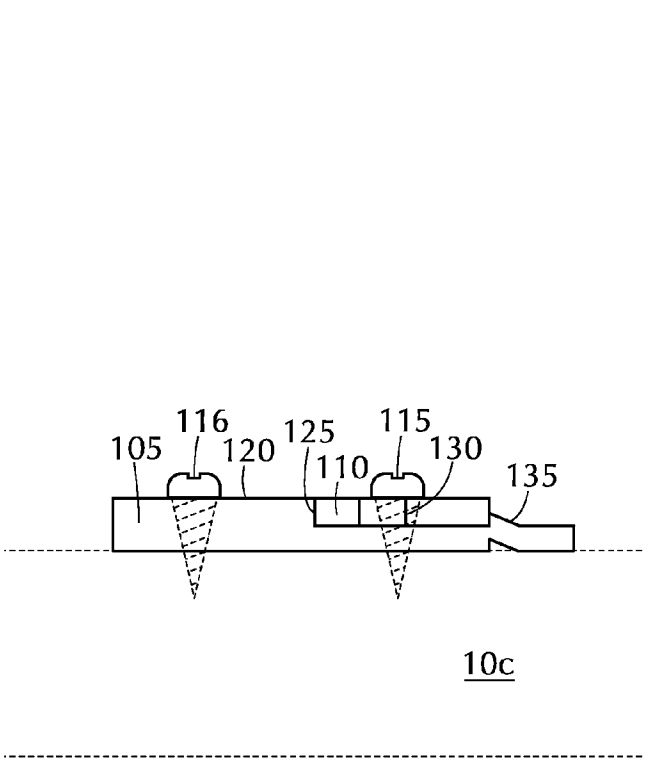
FIG. 1C is the frame hanger of FIG. 1B when viewed from the mounting surface of the frame.
Figure 1A:
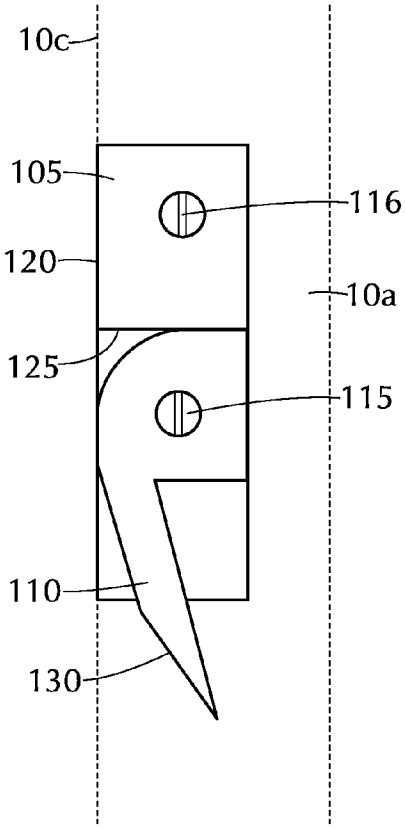
FIG. 1A is a perspective view of a first embodiment of the frame hanger in accordance with the present invention mounted to the interior surface of the frame, wherein the arm is in a fully retracted state.

In a first embodiment of the present invention depicted in FIGS. 1A-1C, frame hanger 100 is a two component system including a fixed section 105 and a single arm 110 rotatable independently of the fixed section 105 about a pivot point 115 (e.g., screw) between two states, i.e., a fully retracted state (FIG. 1A with a pointed end 130 of arm 110 pointing downward toward the floor) and a fully extended state (FIG. 1B). Fixed section 105 is preferably substantially planar (e.g., a plate or sheet of metal) having a top surface and an opposite bottom surface substantially parallel to one another. The bottom surface of the fixed section 105 is in physical contact with the interior surface 10*a* when the frame hanger is installed on the frame 10. Irrespective of the position in which the arm 110 is rotated, fixed section 105 and arm 110 at all times are disposed in two separate planes substantially parallel to one another. A portion of a perimeter of the fixed section 105 is defined by a substantially linear mounting guide edge 120.

When the frame hanger 100 in accordance with the present invention is properly installed on the frame 10, the substantially linear mounting guide edge 120 is substantially aligned with the mounting surface 10*c* of frame 10 to insure the following: (i) arm 110 (while in a fully extended state) is at a predetermined acute angle $\alpha$ relative to a common plane shared by the mounting guide edge 120 and mounting surface 10*c*; (ii) maximum depth of penetration of the arm 110 into the wall (providing maximum weight bearing effect, e.g., up to hundreds of pounds); and (iii) mounting surface 10*c* of the frame 10 is completely flush against the wall on which the framed object is to be hung. While in the fully extended state the position of arm 110 relative to the mounting surface 10*c* defines the acute angle $\alpha$ that is less than 90 degrees. This acute angle $\alpha$ serves to automatically draw mounting surface 10*c* of frame 10 completely flush against the wall or other planar surface on which the framed object is to be hung. Angle $\alpha$ may be between approximately 50 degrees and approximately 80 degrees. Preferably, angle $\alpha$ is between approximately 75 degrees and approximately 80 degrees. Most preferably, angle $\alpha$ is approximately 75 degrees.

Fixed section 105 also has a barrier 125 associated therewith prohibiting rotation of the arm 110 greater than the predetermined acute angle $\alpha$. Barrier 125 may be realized in several ways. For instance, barrier 125 may be a notch or recess defined in the fixed section 105, as illustrated in the embodiment depicted in FIGS. 1A-1C. In a different embodiment illustrated in FIGS. 2A-2C, barrier 225 is defined as an edge along a portion of the perimeter of the fixed section 205. The barrier may otherwise be formed as a projection, bump or nub 325 protruding a sufficient distance from the top surface of the fixed section 105 to intercept arm 110 as it is being rotated, as illustrated in FIGS. 3A-3C. Other mechanical barrier configurations are contemplated and within the intended scope of the invention to prohibit rotation of arm 110 greater than the predetermined acute angle $\alpha$.

While in a fully extended position, arm 110 may be releasably secured or locked in place on its opposite side by a locking feature 135 (e.g. crimp formed in fixed section 105). Preferably, the width of crimp 135 is approximately 1/32". Upon application of sufficient force, arm 110 may be pulled out over the crimp 135 and rotated to the fully retracted state. The crimp may be replaced by a channel defined in the fixed section for receiving therein the arm 110 when in a fully extended state thereby retaining it in place. If desired, a second crimp or channel may also be defined in the fixed section for securing the arm 110 when in a fully retracted position.

Rotatable arm 110 of pin hanger 100 terminates in a single pointed end 130. While in a fully retracted state, the pointed end 130 of arm 110 points downward toward the floor. In the first embodiment illustrated in FIGS. 1A-1C, arm 110 is stamped from a substantially planar piece of metal (e.g., a metal plate with substantially parallel top and bottom surfaces) in the shape of a prong. The angular taper $\beta$ of the prong is selected for ease of entry into the wall or other surface on which the framed object is to be hung. Preferably, the angular taper $\beta$ of the prong is between approximately 10° to approximately 20°. With the exception of its pointed end 130, arm 110 preferably has a substantially uniform lateral width extending in an axial direction backwards away from its pointed end 130. Due to its non-circular cross-section, the stamped prong embodiment is limited in use to hanging the framed object in drywall and restricted in the capacity of weight it is able to support.

Figure 2B:
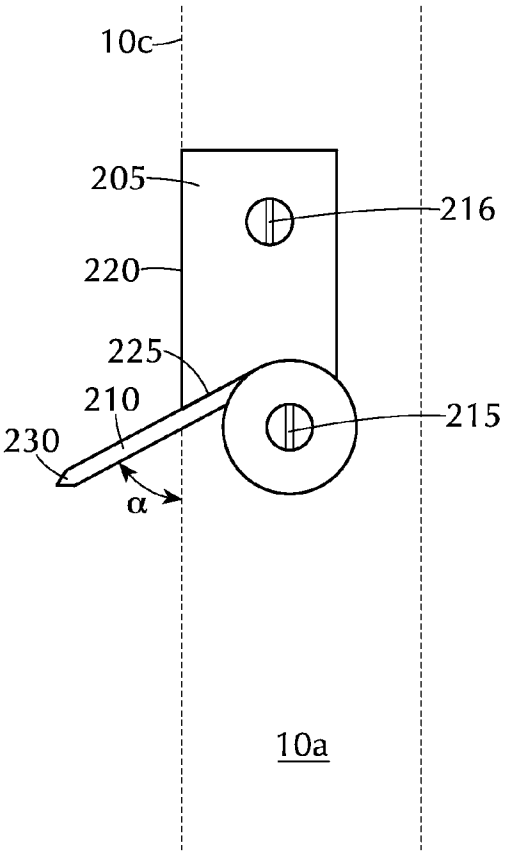
FIG. 2B is a perspective view of the frame hanger of FIG. 2A wherein the arm is in a fully extended state.
Figure 2C:
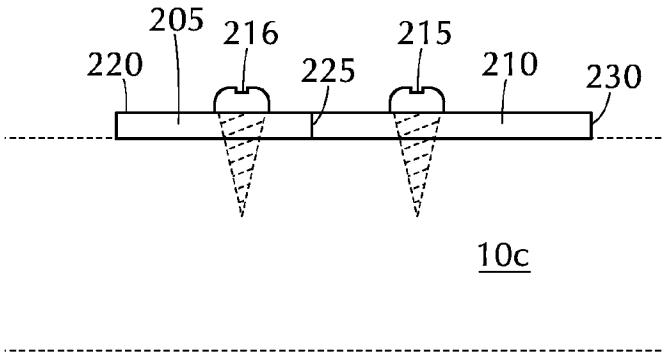
FIG. 2C is the frame hanger of FIG. 2A when viewed from the mounting surface of the frame.
Figure 2A:
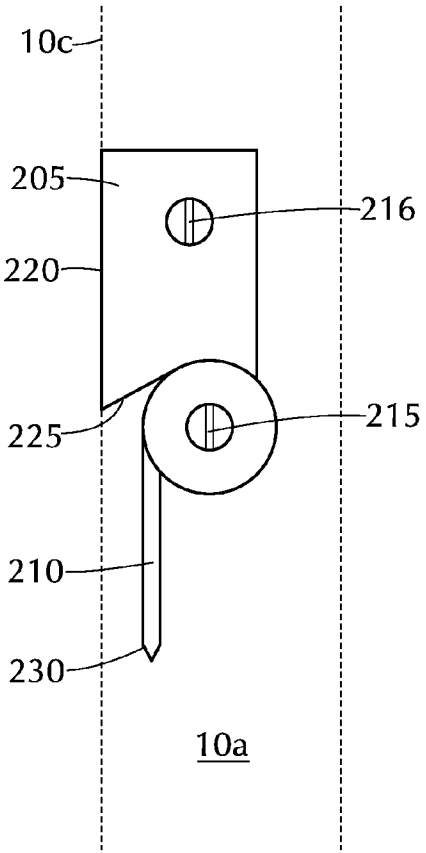
FIG. 2A is a perspective view of a second embodiment of the frame hanger in accordance with the present invention mounted to the interior surface of the frame, wherein the arm is in a fully retracted state.
Figure 3B:
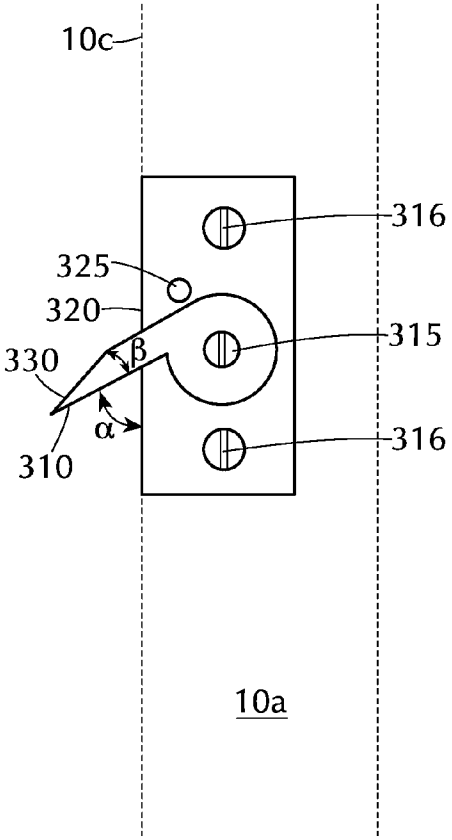
FIG. 3B is a perspective view of the frame hanger of FIG. 3A wherein the arm is in a fully extended state.
Figure 3C:
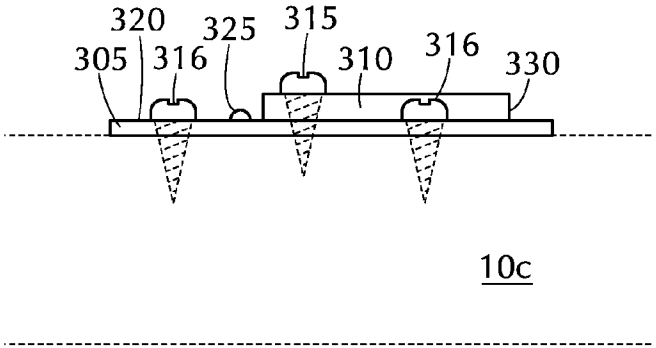
FIG. 3C is the frame hanger of FIG. 3A when viewed from the mounting surface of the frame.
Figure 3A:
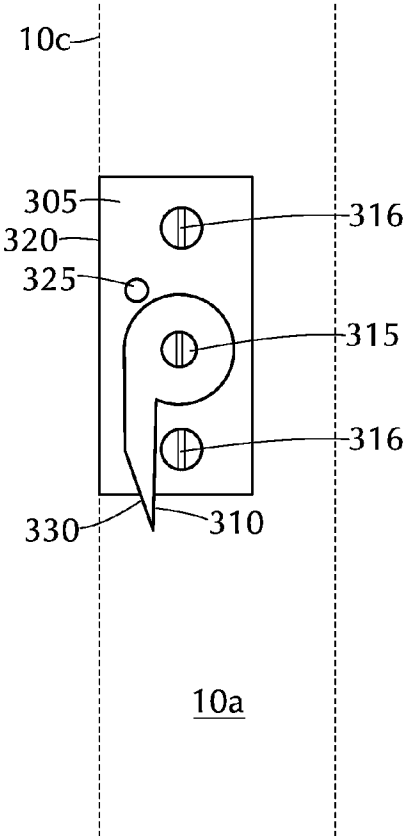
FIG. 3A is a perspective view of a third embodiment of the frame hanger in accordance with the present invention mounted to the interior surface of the frame, wherein the arm is in a fully retracted state.

Instead of being stamped, an arm 210 may be made from a pin or wire having a circular cross-section, as illustrated in FIGS. 2A-2C. Fixed section 205 and rotatable arm 210 both lie in a common single plane. In the fully extended state shown in FIG. 2B, arm 210 is physically in contact with barrier edge 225 of fixed section 205 prohibiting rotation of the arm beyond the predetermined acute angle $\alpha$. One end of arm 210 terminates in a pointed end 230 to easily puncture the wall when the user presses firmly on the framed object, while its opposite end is wound about or otherwise secured (e.g., adhered, welded, riveted) to a supporting element (e.g., disc) through which a screw 215 or other device extends therethrough. Screw 215 may be tightened/released to restrict/allow rotation of the pin arm 210 between its fully retracted and fully extended states. Irrespective of the position of rotation of the arm 210, the frame hanger may be maintained secured to the interior surface 10*a* of the frame 10 without requiring disassembly. At every point in an axial direction, the arm 210 preferably has a circular cross-section. With the exception of its pointed end 230, arm 210 preferably has a substantially uniform diameter circular cross-section. Because of its circular cross-section, by merely pushing on the display surface of the frame, arm 210 is able to be installed on a variety of surfaces such as wood, metal, cement, dry wall, glass, steel, etc. on which the framed object is to be hung. If the surface into which the arm is to be inserted is significantly hard so as to preclude insertion by mere pushing, a pilot hole may be predrilled into the surface.

All components of the present inventive hanging system are secured directly to the frame itself, thereby eliminating the need for any complementary/mating frame hanger component to be secured separately directly to the wall. With the embodiments described heretofore, the fixed portion and arm may be independently secured to the interior surface 10*a* of each of the pair of vertical parallel sides of frame 10 by any conventional method such as, but not limited to adhered, stapled, nailed, screwed, riveted, etc.

Yet another embodiment of the present inventive frame hanger is depicted in FIGS. 3A-3C in which the fixed section 305 and rotatable arm 310 lay in two different planes substantially parallel to one another. Once again, fixed section 305 is secured to the interior surface 10*a* of frame 10 by one or more mechanical devices 316 (e.g., adhesive, screw, rivet, staple, or nail). Arm 310 may be tightened/released to prohibit/allow rotation thereof about the pivot point between the fully extended and fully retracted states via a screw 315 passing through an opening defined in the fixed section 305 and secured into the interior surface 10*a* of frame 10. As shown in FIGS. 3A and 3B, arm 310 is freely rotatable between a fully retracted state and a fully extended state. Barrier 325 formed as a projection, numb or button protruding from the top surface of the fixed section 305 intercepts with and thus prohibits arm 310 from rotating greater than the predetermined acute angle α (representative of a fully extended state). To retain arm 310 in a fully extended state, the frame hanger may include a releasable locking device such as a crimp in the fixed section 305 similar to that illustrated and described with respect to the embodiment in FIGS. 1A-1C.

Figure 7A:
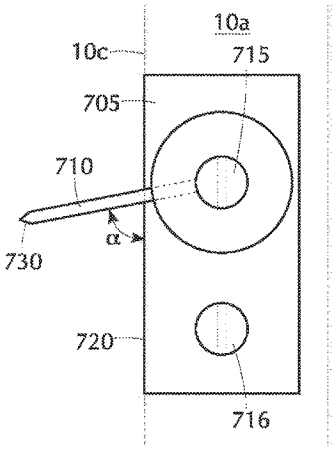
FIG. 7A is a perspective view of a fifth embodiment of the frame hanger in accordance with the present invention mounted to the interior surface of the frame, wherein the arm is in a fully extended state.
Figure 7B:
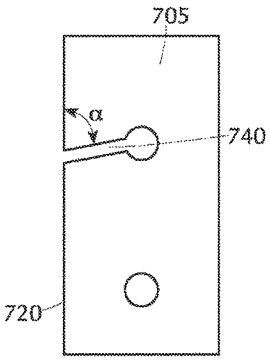
FIG. 7B is a perspective view of the fixed section in FIG. 7A.
Figure 7C:
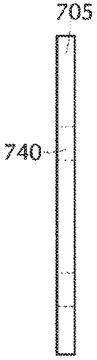
FIG. 7C is a side view of the fixed section of FIG. 7B.
Figure 7D:
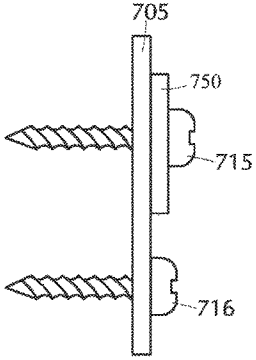
FIG. 7D is a side view of the frame hanger in FIG. 7A.
Figure 7F:
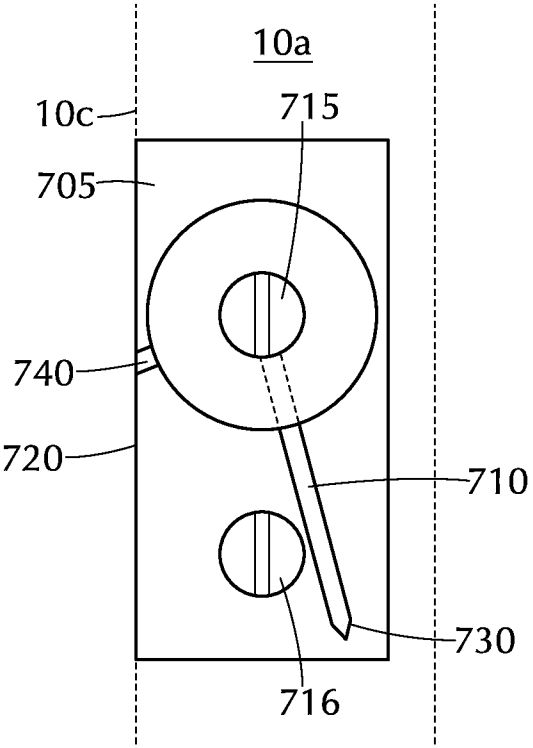
FIG. 7F is a perspective view of the frame hanger in FIG. 7A, wherein the arm is in a fully retracted state.
Figure 7E:
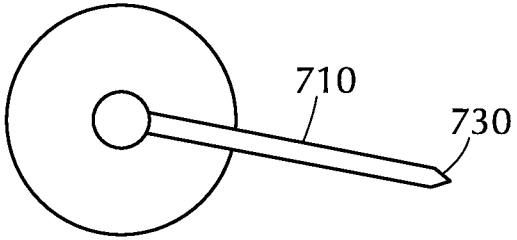
FIG. 7E is a perspective view of the disc and rotatable arm in FIG. 7A.

Yet another alternative embodiment of the hanging system in accordance with the present invention is depicted in FIGS. 7A-7F. Fixed section 705 has a key hole 740 defined therein. The key hole 740 is defined at the predetermined acute angle α relative to the substantially linear mounting guide edge 720 so that when rotated to its fully extended state arm 710 is received therein securing or locking it in place. Arm 710 may be mounted (e.g., welded) to a supporting member 750 (e.g., disc or washer) or formed as a single integral component. Together the disc and arm 710 are secured to the interior surface 10*a* of the frame via a screw 715 or other releasable securing device. Fixed section 705 and arm 710 lay in two different planes that are substantially parallel with one another. Arm 710 has a circular cross-section like a pin. When mounted to the disc, arm 710 is preferably substantially centered so that a single universal device is interchangeably suitable to be installed on either the left or right hand sides of the vertically oriented pair of substantially parallel frame sections by simply flipping it over. As illustrated in FIG. 7F, while in a fully retracted state ready to be transported, arm 710 may be retained in a positioned beneath the screw head 716.

Irrespective of the particular embodiment, while in a fully extended state in physical contact with the barrier, the arm is at the desired predetermined acute angle α relative to the plane shared by both the mounting guide surface of the hanger and the mounting surface 10*c* of the frame. In the fully extended state out of the way the arm 710 extends beyond (i.e., intersects with) the mounting surface 10*c* of the frame 10. Whereas in the fully retracted state, the pointed end 730 of the arm 710 is angled downward towards the floor such that no portion of the arm 710 extends beyond (i.e., intersects with) the mounting surface 10*c* of the frame 10.

At all times, the fixed section and the arm of the frame hanger as well as the interior surface of the frame all lay in a shared common plane or different planes substantially parallel to one another. When not in use, the arm is rotatable substantially parallel to the interior surface 10*a* of each of the pair of vertically oriented substantially parallel frame sections, rather than parallel to the display surface 10*d* or back of the object to be displayed. Accordingly, the present inventive pin hanging system is particularly advantageous when installed on a framed canvas, since it is secured only to the interior of the vertical sides of the frame, not to the back of the canvas that may otherwise destroy the work of art or any backboard that supports the canvas.

Thus far, the embodiments have been shown and described with respect to a single frame hanger installed on an interior surface 10*a* of a single frame section of the pair of vertically oriented substantially parallel frame sections. Hanging a framed object on the wall or other surface in accordance with the present inventive system calls for the frame hangers to be assembled on the interior surface 10*a* of each of the pair of vertically oriented substantially parallel frame sections. Preferably, an equal number of one or more frame hangers is disposed on each vertically oriented pair of substantially parallel frame sections. Each frame hanger has only a single pointed arm, prong or pin.

Figure 4B:
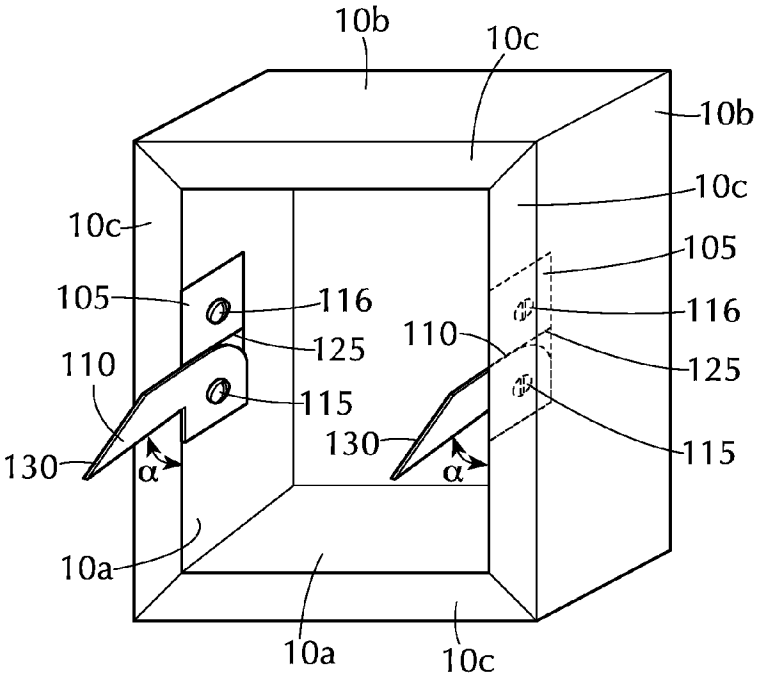
FIGS. 4A-4C are side views of the sequential steps in installing the hanging system of FIG. 1A mounted to a framed object to be hung on a wall.
Figure 4A:
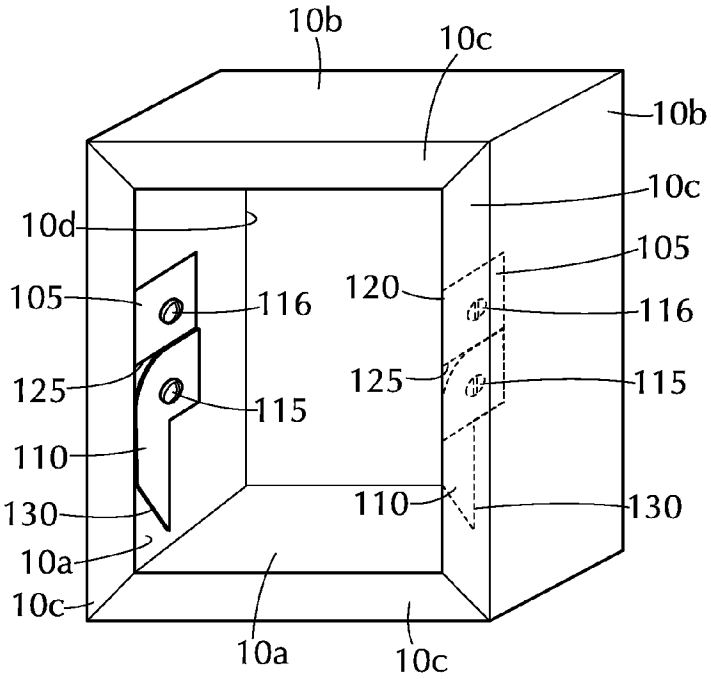

During installation of the hanging system 400 in accordance with the present invention on a framed object, a single frame hanger 100 is secured to the interior surface 10*a* of each of the vertically oriented substantially parallel frame sections, as illustrated in FIG. 4A. Preferably, frame hanger 100 is positioned on the vertically oriented substantially parallel frame section approximately ¼ the way down from the top of the frame. The present inventive hanging system advantageously provides leeway or tolerance in positioning of the frame hangers on the frame, thus eliminating the need for the two frame hangers on each of the pair of vertically oriented substantially parallel frame sections to be disposed precisely equidistance from the top of the frame.

The process for securing each of the frame hangers 100 to the interior surface 10*a* of the frame 10 is the same and thus only one frame hanger installation will be described in detail with respect to the frame hanger embodiment in FIG. 1A. Methods of installation for the other disclosed embodiments are similar to that described with respect to FIG. 1A. Initially, the substantially linear mounting guide edge 120 is preferably substantially aligned with the mounting surface 10*c* of frame 10. This will not only maximize the depth of penetration of the arm 110 into the wall, but will simultaneously guarantee that the arm 110 while in the fully extended state is at the predetermined acute angle α relative to the mounting surface 10*c* so that the frame object is drawn flush against the wall 410. It is also contemplated that the substantially linear mounting guide edge 120 may be substantially parallel to but disposed inward from the mounting surface 10*c* of the frame (once again no portion of the fixed section 105 extends beyond the mounting surface 10*c*). In such configuration, less than a maximum depth of penetration of the arm 110 into the wall 410 will be realized thereby possibly reducing the weight bearing capability of the hanging system. Once properly aligned, the frame hanger is secured in place to the interior surface 10*a* of the frame 10 using any conventional device and/or method, such as adhesive, staple, nail, screw, etc. The fixed section 105 may be secured separately (e.g., screw 116) from that of the arm 110 (e.g., screw 115) to the interior surface 100*a* of the frame 10. Alternatively, a single securing device (e.g., screw) may be used to secure both the fixed section 105 and arm 110 to the interior surface 10*a* of the frame 10. The securing device (e.g., screw 115) associated with the arm 110 may, if necessary, be released to permit rotation of the arm 110 to a desired state. While in the fully retracted state, no portion of the arm 110 extends beyond the mounting surface 10*c* of the frame. Accordingly, the hanging system may be installed on the interior surface 10*a* of the framed object at the time and place of manufacture. While in a fully retracted state, the framed object with the installed hanging system may be shipped to the distributer, retailer, consumer or any intended party without increasing the overall size footprint while simultaneously accommodating all safety concerns associated with the pointed end of the arm. Of course, rather than be installed to the framed object at the time of place and manufacture, the hanging system may be sold separately and then installed by the consumer to the framed object.

Figure 4C:
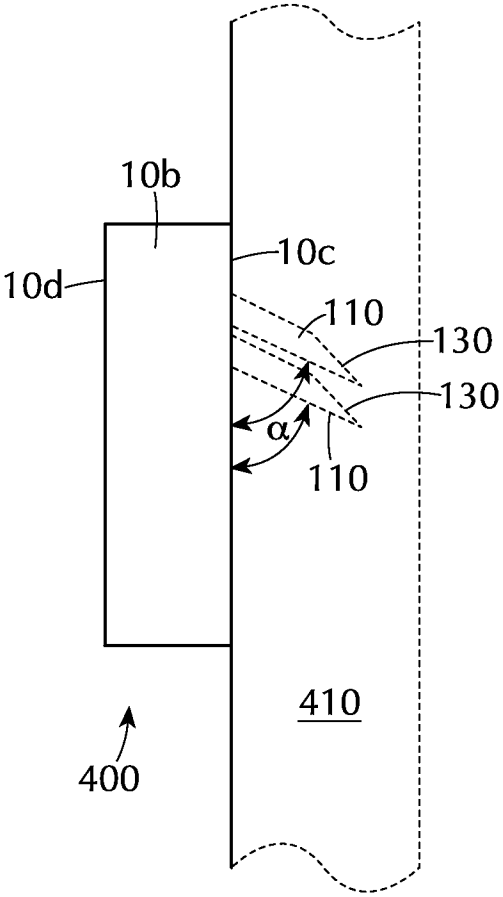

The shipped framed object is received by the retailer or consumer with the pointed ends 130 of the arms 110 in a fully retracted state so as to not cause injury. Prior to installing the framed object on a wall 410 or other surface on which it is to be hung, the user rotates the arm 110 from its fully retracted state to a fully extended state in which it is in physical contact with the barrier 125 of the fixed section. A tool such as a screwdriver, may but need not necessarily be used, to allow rotation of the arm 110 between the fully retracted and fully extended states. In the fully extended state, the frame hangers are automatically at the proper predetermined acute angle $\alpha$ relative to the plane common to both the mounting surface 10*c* of the frame and the substantially linear mounting guide edge 120 of the frame hanger. With the two arms of the respective two frame hangers independently rotated to the fully extended state, the user orients the frame by resting the bottom horizontal edge mounting surface 10*c* against the wall. Resting of the frame against the wall simultaneously provides both stability and a leverage point (e.g., fulcrum). While the bottom horizontal edge mounting surface 10*c* is resting against the wall, the user presses on the display surface 10*d* of the framed object proximate the frame hangers causing the pointed ends 130 to penetrate into the wall 410 until the mounting surface 10*c* of the frame is completely flush against the wall, as shown in FIG. 4C. Where the pointed ends 130 penetrate into the wall results in minimal damage (two puncture holes) in the dry wall or other surface on which the frame is hung. Should the user wish to take the frame object down from the wall, only minimal repair is required to fill in the two puncture holes with spackle. Furthermore, the frame object may be easily taken off the wall, for example, to clean or paint the wall, by simply pulling on the framed object until the arms 110 are fully extracted from the wall. Thereafter, the framed object may be easily re-hung utilizing the same penetration holes in the wall by inserting the arms 110 back therein without any compromise in weight bearing capability. Since the penetration holes are being reutilized, less force will be required to push the frame until its mounting surface 10*c* is completely flush against the wall.

Figure 6B:
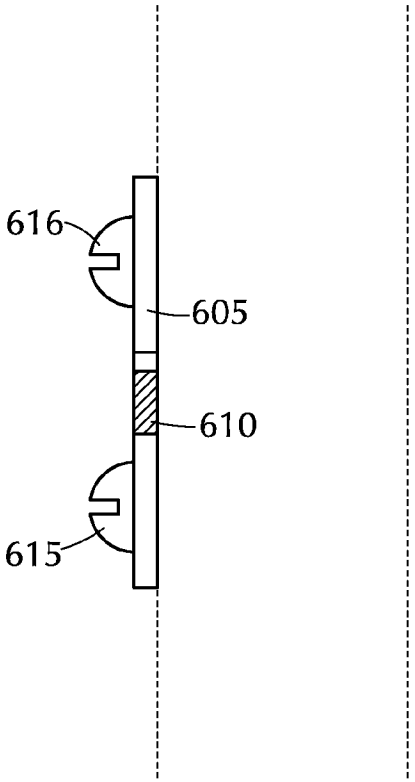
FIG. 6B is the frame hanger of FIG. 6A when viewed from the mounting surface of the frame.
Figure 6A:
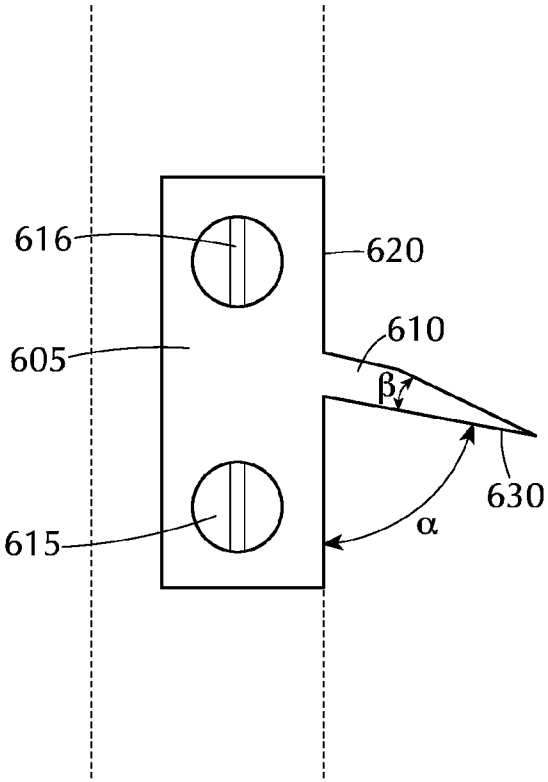
FIG. 6A is a perspective view of a fourth embodiment of the frame hanger in accordance with the present invention mounted to the interior surface of the frame, wherein the arm is non-rotatable.

Heretofore, the embodiments of the present inventive frame hanger have all employed an arm rotatable relative to the fixed section between a fully extended state and a retracted state. It is also contemplated and within the intended scope of the present invention for the arm to be integral with and fixed (non-rotatable) relative to the fixed section, as shown in FIGS. 6A & 6B. The frame hanger is preferably stamped from a sheet of metal as a single integrated component wherein the fixed section 605 and arm 610 lie within a single plane. As with the previously discussed embodiments, the substantially linear mounting guide edge 620 is substantially aligned with the mounting surface 10*c* of the framed object. However, since the arm 610 of the frame hanger is not rotatable relative to that of the fixed section 605 to a retracted state out of the way, the frame hanger is to be installed or assembled on to the frame object (not by the manufacturer/distributor/retailer) by the consumer himself upon receiving the framed object at its place of intended use. If sufficient depth clearance is provided on the frame, the framed object may be shipped or transported with the arm 610 of the frame hanger assembled to the interior surface 10*a* and the pointed end 630 pointing towards the display surface 100*d* of the frame. Upon receiving the framed object, the consumer simply unscrews the frame hanger from the frame and flips it over so that its linear mounting guide edge 620 is substantially aligned with the mounting surface 10*c* of the framed object and the pointed end 630 pointing away from the mounting surface 10*c*. With the frame hanger properly assembled to the interior surface 10*a* of the frame, the framed object may now be hung by simply pressing the framed object against the wall causing the arms 610 to penetrate the wall until the mounting surface 10*c* of the frame is completely flush against the wall.

The present invention eliminates the need for wires to hang a framed object to a wall or a second complementary/mating frame hanger component to be secured directly to the wall. Furthermore, the present inventive pin hanging system insures that a framed object once level remains so and is maintained completely flush against the wall on which it is hung thereby providing further stability. The simplified inventive design is relatively inexpensive to manufacture, easy to install with minimal if any tools required, yet provides significant weight bearing capacity up to hundreds of pounds. With the present inventive pin hanging system, since there are no sharp protruding objects all safety concerns are overcome when shipping the framed object. Furthermore, the framed object along with the installed present inventive pin hanger may be shipped without increasing its overall size. This is advantageous in that the framed objects may then be transported utilizing predefined size packaging or cartons. Since there are no pins protruding from the mounting surface of the frame, multiple framed objects may be packaged together (e.g., back-to-back or front-to-front) in a single carton without any damage to the frame or object. An additional advantage of the present inventive pin hanging system is that it suitable for use with any size or shape frame.

Preferably, the configuration of the frame hanger is universally interchangeably suitable to be installed on either the left or right hand sides of the vertically oriented pair of parallel frame sections. Mirror configurations of one another of the frame hanger could otherwise be manufactured, one configured exclusively for the right-hand-side vertically oriented frame section, the other configured exclusively for the left-hand-side vertically oriented frame section.

Because the present inventive frame hanger is secured only to the interior surface of the vertically oriented parallel frame sections there is no need for a backing board or any other supporting structure spanning the display surface 100*d* of the frame. This is particularly advantageous when hanging a canvas stretched directly across the display surface of the frame without any backing board, substrate or supporting structure.

The object to be framed has no impact on the scope of the present invention. Instead, the objects enumerated are by way of illustrative example only. Typically, the frame is made of wood due to the fact that it is a plentiful, lightweight material at relatively inexpensive cost. Other materials are suitable for the frame so long as the frame has an interior surface 10*a* with a substantially planar mounting surface 10*c* to which the substantially linear mounting guide edge of the fixed section of the frame hanger may be substantially aligned. Preferably two frame hangers are installed on a frame, one frame hanger mounted to each of the vertically oriented frame sections. To provide greater weight bearing capability, a total of four frame hangers may be installed on a frame, i.e., two frame hangers mounted to each of the vertically oriented frame sections.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

Every issued patent, pending patent application, publication, journal article, book or any other reference cited herein is each incorporated by reference in their entirety.

What is claimed is:

1. A frame hanger comprising:

a substantially planar fixed section having a top surface, a bottom surface and a perimeter; a portion of the perimeter of the substantially planar fixed section defining a substantially linear mounting guide edge;

a single arm rotatably mounted to the substantially planar fixed section between a fully extended state and a fully retracted state; the arm terminating in a pointed end; while in the fully retracted state, no portion of the arm extends beyond the substantially linear' mounting guide edge of the substantially planar fixed section; while in the fully extended state the pointed end of the arm extends beyond the substantially linear mounting guide edge of the substantially planar fixed section; and a barrier formed within the substantially planar fixed section for prohibiting rotation of the arm greater than a predetermined acute angle relative to the substantially linear mounting guide edge in the fully extended state; wherein the barrier is a recess formed within the substantially planar fixed section;

wherein in both the fully extended state and the fully retracted state the arm and the substantially planar fixed section lie in two planes substantially parallel to one another;

wherein while in the fully extended state, a longitudinal axis of the arm is receivable within a longitudinal axis of the recess;

wherein, the frame hanger eliminates needing a hanging wire.

2. The frame hanger in accordance with claim 1, wherein the predetermined acute angle is in a range between approximately 50 degrees and approximately 80 degrees.

3. The frame hanger in accordance with claim 1, wherein the arm has a circular lateral cross-section.

4. The frame hanger in accordance with claim 1, wherein the arm and the substantially planar fixed section each have at least one hole defined therein for receiving therein a releasable securing device.

5. The frame hanger in accordance with claim 4, wherein one of the at least one hole defined in the arm and the substantially planar fixed section are substantially aligned.

6. The frame hanger in accordance with claim 1, wherein the substantially planar fixed section has a releasable locking member.

7. A method for hanging on a wall an object, displayed on a frame using two frame hangers; each of the two frame hangers including a substantially planar fixed section and a single arm the method comprising the steps of:

a) positioning the substantially planar fixed section of each of the frame hangers so that the substantially linear mounting guide edge is aligned with a mounting surface of the frame with a pointed end of each single arm oriented away from the frame; each of said substantially planar fixed section having a top surface, a bottom surface and a perimeter; a portion of the perimeter of the substantially planar fixed section defining a substantially linear mounting guide edge; a barrier associated with the substantially planar fixed section for prohibiting rotation of the single arm when in a fully extended state, greater than a predetermined acute angle relative to the substantially linear mounting guide edge; wherein the barrier is a recess formed within the substantially planar fixed section; and each of the two frame hangers including the single arm terminating in the pointed end; the pointed ends of the single arms project from the respective substantially linear mounting guide edges of the substantially planar fixed sections at an angle between approximately 50 degrees and approximately 80 degrees; the frame having two vertically oriented substantially parallel frame sections, an interior surface, an opposite exterior surface, the mounting surface to be flush against the wall when the frame is hung, and an opposite display surface on which the object is displayed, b) securing each of the frame hangers to the interior surface of each of the two vertically oriented substantially parallel frame sections;

c) resting a horizontal bottom edge of the mounting surface of the frame against the wall at a desired position in which the frame is to be hung;

d) using as a leverage point the horizontal bottom edge of the mounting surface of the frame resting against the wall, e) pressing on the frame proximate a horizontal top edge of the display surface of the frame puncturing the wall with the pointed ends of the single arms of the respective frame hangers; and f) pushing each of the single arms farther into the wail until the mounting surface of the frame is completely flush against the wall;

wherein in both the fully extended state and a fully retracted state each of the single arms is rotatable relative to the respective substantially planar fixed section between the fully extended state and the fully retracted state; while in the fully retracted state, no portion of the single arms extends beyond the respective substantially linear mounting guide edge of the respective substantially planar fixed section; while in the fully extended state the pointed end of the single arms extends beyond the substantially linear mounting guide edge of the respective substantially planar fixed sections;

wherein in both the fully extended state and the fully retracted state the single arms and the respective substantially planar fixed sections lie in two planes substantially parallel to one another; wherein while in the fully extended state, a longitudinal axis of the single arm is receivable within a longitudinal axis of the recess wherein said recess is formed within the substantially planar fixed section; wherein the frame hanger eliminates needing a hanging wire.

8. The method in accordance with claim 7, wherein each of the single arms rotates in a plane substantially parallel to that of the interior surface of the two respective vertically oriented substantially parallel frame sections.

* * * * *